United States Patent [19]

Beecroft

[11] 4,067,368

[45] Jan. 10, 1978

[54] CABIN LOG SHAPER

[76] Inventor: William K. Beecroft, Rte. 2, Box 109, Frederic, Wis. 54837

[21] Appl. No.: 678,682

[22] Filed: Apr. 20, 1976

[51] Int. Cl.[2] ..... B27C 5/00

[52] U.S. Cl. ..... 144/3 R; 83/5; 83/485; 83/488; 144/134 R; 144/136 H; 144/218; 144/322; 269/56

[58] Field of Search ..... 144/1 R, 3 R, 2 R, 41, 144/114, 117 R, 117 B, 134 R, 134 B, 136 R, 136 H, 208 R, 208.6, 218, 133, 321, 322, 323, 326 R; 83/5, 485, 487, 488; 269/55, 56

[56] References Cited

U.S. PATENT DOCUMENTS

| | | | |
|---|---|---|---|
| 1,543,165 | 6/1925 | Kessler | 83/5 X |
| 1,630,173 | 5/1927 | Dumont | 144/134 R |
| 1,797,646 | 3/1931 | Gardner | 83/5 |
| 3,517,576 | 6/1970 | Hilty et al. | 83/5 |
| 3,718,958 | 3/1973 | Brucker | 144/218 R |

*Primary Examiner*—Harrison L. Hinson
*Assistant Examiner*—W. D. Bray
*Attorney, Agent, or Firm*—Clarence A. O'Brien; Harvey B. Jacobson

[57] ABSTRACT

An elongated base is provided including elongated guide structure extending therealong. A router assembly is supported from the guide structure for guided movement therealong in a predetermined path and the base includes support structure for supporting an elongated log in position extending along a center axis generally paralleling and adjacent the aforementioned predetermined path. The router assembly includes cutting blade structure operative to form a convex generally semi-cylindrical surface on the adjacent side of a log supported from the support structure and the latter is operative to engage and support the log from the semi-cylindrical surface formed thereon after the surface is formed and the log is rotated 180° about its longitudinal axis with the log then supported in position for forming a second semi-cylindrical surface on the side of the log then opposing the path of movement of the router assembly with the second semi-cylindrical surface having an axis of curvature coinciding with the axis of curvature of the first formed semi-cylindrical surface. The cutter blades of the router assembly further include blade portions operative to form shallow keyways in the central portions of the semi-cylindrical surfaces formed thereby.

10 Claims, 12 Drawing Figures

CABIN LOG SHAPER

BACKGROUND OF THE INVENTION

Various forms of machinery have been provided for debarking and forming generally cylindrical logs from tree logs and other structures have been provided for transforming tree logs into substantially cylindrical cabin logs including transverse grooves in the ends of the cabin logs whereby adjacent end portions of right-angularly disposed logs may be keyed together in the conventional manner utilized in constructing a log cabin or similar building structure.

Examples of log debarking machinery and other devices including comparable structure are disclosed in U.S. Pat. Nos. 1,692,028, 2,401,500, 2,733,742 and 2,902,070, whereas a cabin log shaping apparatus is disclosed in U.S. Pat. No. 3,791,430.

However, these previously patented devices require structure for supporting a log or similar member for rotation about its longitudinal axis and thus require considerable bearing structures capable of rotatably cradling or journaling a heavy log. In addition, substantially all of these prior structures include cutting blades or members which are rotated in planes transverse to the log or similar structure upon which the cutting action is to be performed and which are therefore not capable of shaping the log by means of a longitudinal pass therealong while simultaneously forming a lengthwise keyway in the log. In addition, these previously known structures are cumbersome to use and are not readily adjustable to logs of different diameters.

Accordingly, a need exists for an apparatus which may receive logs of varying diameters and transform those logs into cylindrical cabin logs of the same diameter with diametrically opposite sides of the cabin logs being provided with longitudinal keyways.

BRIEF DESCRIPTION OF THE INVENTION

The shaper of the instant invention includes structure for cradling a tree log from its underside and forming a semi-cylindrical surface on the upper side of the tree log including a central upwardly opening keyway and which is thereafter operable to support that partially completed cabin log in a 180° rotated position with its first formed cylindrical surface lowermost and the center axis of the first formed semi-cylindrical surface coinciding with the center axis of the second formed semi-cylindrical surface on the then upper side of the log with the second semi-cylindrical surface also including a central upwardly opening keyway.

Structure is also provided whereby the opposite ends of selected logs may have transverse outwardly opening concave generally semi-cylindrical mortising grooves formed therein through the utilization of a conventional chain saw.

The main object of this invention is to provide a cabin log shaper which will be operative to transform a tree log into a cylindrical cabin log having its opposite sides provided with outwardly opening longitudinal keyways.

Another object of this invention is to provide a log shaper in accordance with the preceding object and which will be readily adjustable to tree logs of different diameters in order to form cabin logs of the same diameter.

Yet another object of this invention is to provide a log shaper constructed in a manner whereby it may be readily trailed in the manner of a trailer from one location to another.

A still further important object of this invention is to provide a log shaper which is readily adjustable to tree logs of different lengths.

A final object of this invention to be specifically enumerated herein is to provide a log shaper in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
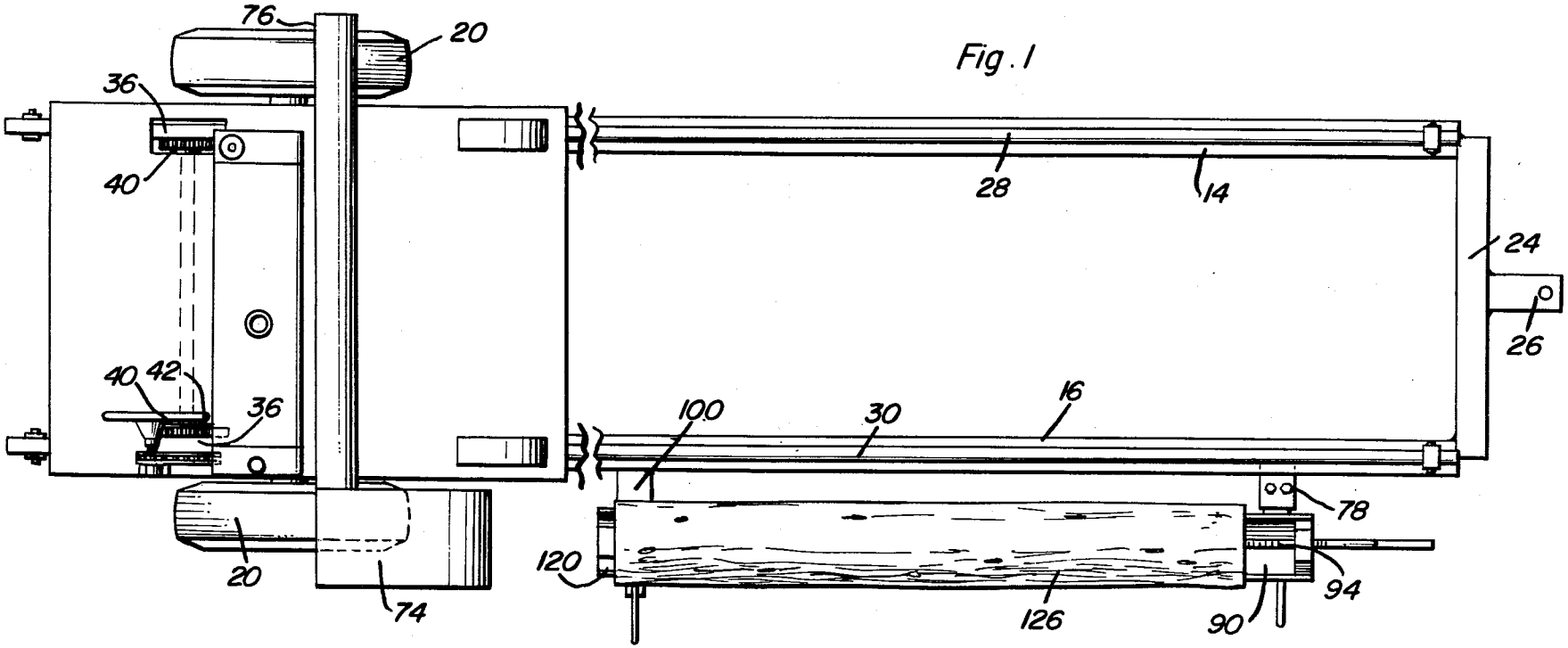
FIG. 1 is a fragmentary plan view of the log shaper of the instant invention.

Referring now more specifically to the drawings, the numeral 10 generally designates the log shaper of the instant invention. The shaper 10 includes an elongated frame or base referred to in general by the reference numeral 12 and consisting of a pair of opposite side longitudinal beams 14 and 16 suitably braced intermediate their opposite ends. A wheeled transverse axle assembly referred to in general by the reference numeral 18 extends between and is supported from the rear ends of the longitudinal members or beams 14 and 16. The wheels 20 journaled from the opposite ends of the axle assembly 18 outwardly of the members 14 and 16 are of sufficient diameter to space the beams or members 14 and 16 appreciably above the ground surface 22 upon which the wheels 20 rest.

The forward ends of the beams 14 and 16 are interconnected by means of a transverse member 24 including a forwardly projecting tow hitch 26 whereby the entire shaper 10 may be trailed behind a draft vehicle.

A pair of track rails 28 and 30 are supported from the beams 14 and 16 and a carriage assembly referred to in general by the reference numeral 32 is supported from the rails 28 and 30 for movement therealong. The carriage assembly includes a support frame referred to in general by the reference numeral 34 including a first pair of drive wheels 36 journaled from the rear ends thereof and a second pair of idle wheels 38 journaled from the front end thereof. The wheels 36 and 38 are rollingly engaged with the rails 28 and 30 and the wheels 36 have gear wheels 40 mounted thereon with which small diameter gear wheels 42 mounted on a jackshaft 44 journaled from the frame 34 as at 46 are meshed. One end of the jackshaft 44 has a sprocket wheel 48 mounted thereon and a drive shaft 50 is journaled from the upper end of a standard 52 supported from the frame 34 and has a sprocket wheel 54 mounted on one end thereof aligned with the sprocket wheel 48. An endless drive chain 56 is trained about the sprocket wheels 48 and 54 and the end of the drive shaft 50 remote from the sprocket wheel 54 has a handwheel 58 mounted thereon whereby the drive wheels 36 of the support frame 34 may be hand-driven at any desired slow speed.

A prime mover referred to in general by the reference numeral 60 is supported from the frame 34 and is drivingly connected to a router or cutter head referred to in general by the reference numeral 62 journaled from a forward portion of the support frame 34. The router or cutter head is in the form of a drum 64 having four equally circumferentially spaced and radially outwardly projecting cutter blade assemblies 66 mounted thereon. Each cutter blade assembly includes a semi-cylindrical edge 68 interrupted at its center portion by means of a blade element 70 extending inwardly along the central radius of the edge 68. The opposite ends of edge 68 terminate in outwardly directed radial edges 72.

Figure 6:
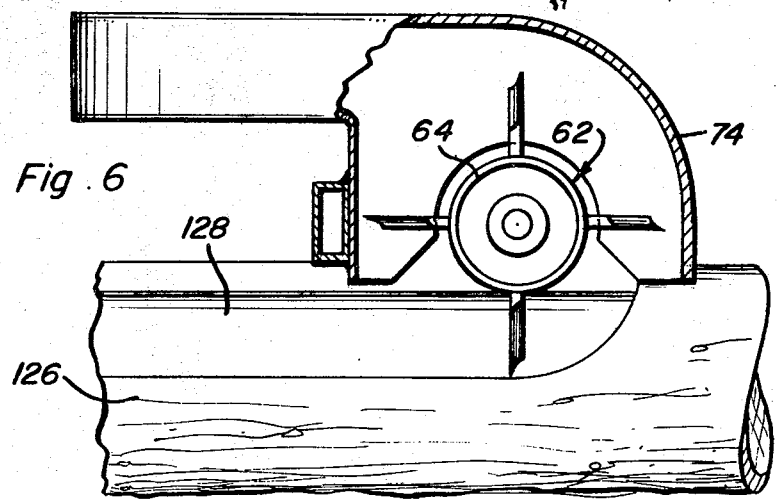
FIG. 6 is a fragmentary longitudinal vertical sectional view illustrating the manner in which the router or cutter assembly performs the initial cut on a tree log during its transformation into a cabin log.

The router or cutter head 62 is enclosed within a shroud 74 which opens downwardly at one end and horizontally outwardly as at 76 at its other end. The router or cutter head 62 is substantially fully enclosed within the downwardly opening inlet end of the shroud 74 and high speed rotation of the router or cutter head 62 in a counterclockwise direction as viewed in FIG. 6 of the drawing enables the router or cutter head 62 to function in the manner of a blower wheel whereby chips of wood removed by the router or cutter head 62 will be drawn inwardly through the downwardly opening inlet end of the shroud 74 and discharged horizontally outwardly of the outlet end 76 of the shroud 74.

The forward end portion of the beam or member 16 includes a horizontally outwardly projecting tubular mount 78 in which a horizontally outwardly extending arm 80 is snugly and slidably received, the mount 78 including setscrews 82 operatively associated therewith and engageable with the inner end of the arm 80 to retain the latter in adjusted outwardly extending position relative to the outer end of the tubular member or mount 78. The outer end of the arm 80 includes an upstanding tubular sleeve 84 in which the lower end of a standard 86 is snugly and slidably received, the sleeve 84 having a setscrew 88 operatively associated therewith engageable with the standard 86 in order to retain the latter in adjusted vertically shifted position relative to the sleeve 84. In addition, the sleeve 84 includes a jacking lever 89 oscillatably supported therefrom and engageable with the lower end of the standard 86 within the sleeve 84 whereby the standard 86 may be elevated or lowered as desired within the sleeve 84 upon loosening of the setscrew 88 and the adjusted elevation of the standard 86 may then be retained upon tightening of the setscrew 88.

Figure 9:
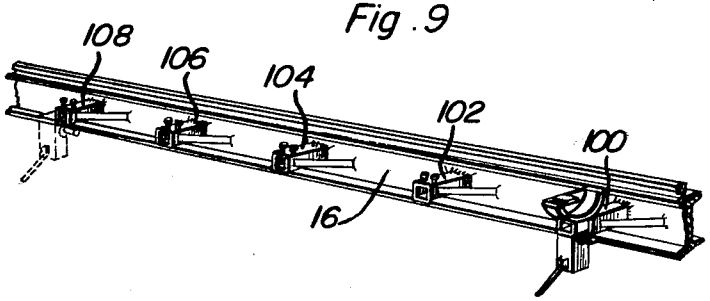
FIG. 9 is a fragmentary perspective view of one side of the elongated base of the log shaper illustrating the plurality of longitudinally spaced mounts from which one of the end head blocks for supporting a tree log may be mounted in order to adjust the shaper to receive tree logs of different lengths.
Figure 8:
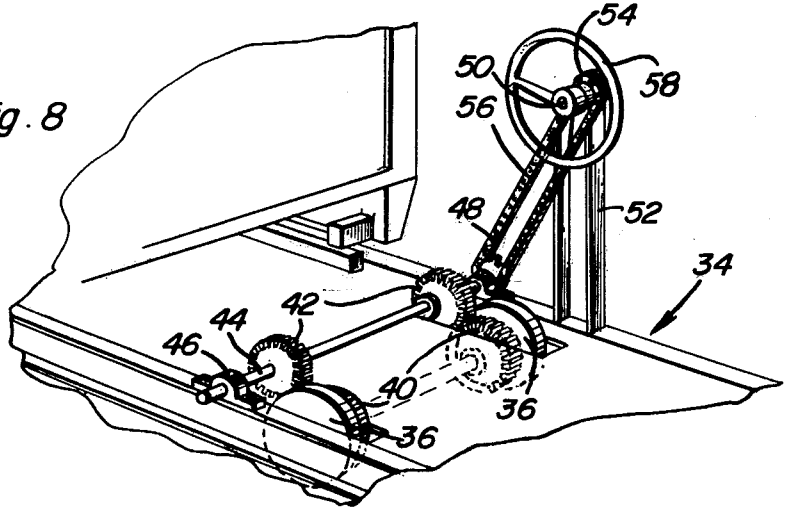
FIG. 8 is a fragmentary perspective view illustrating the manual drive for the router carriage.
Figure 2:
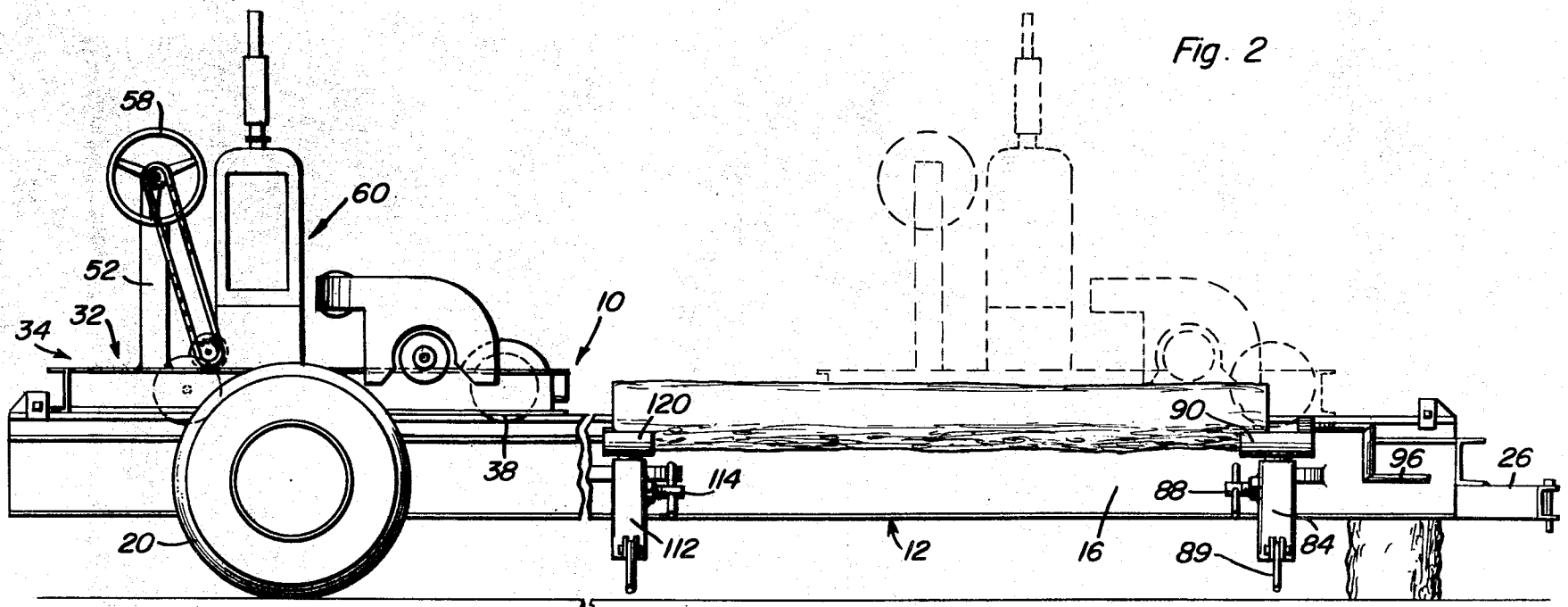
FIG. 2 is a fragmentary side elevational view of the log shaper of the instant invention.
Figure 7:
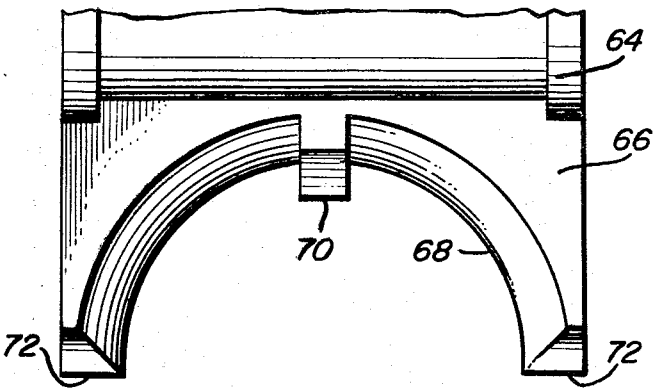
FIG. 7 is a fragmentary side elevational view of the router or cutter assembly illustrating the elevational shape of one of the four cutter blades thereof.

The upper end of the standard 86 supports an upwardly opening partial cylindrical cradle 90 including a central guide lug 92 and a horizontal threaded shaft 94 is threadedly supported from the forward portion of the cradle 90 and includes a crank handle 96 on its forward end. In addition, as may be seen from FIGS. 5 and 9 of the drawings, the beam 16 further includes a plurality of longitudinally spaced mounts 100, 102, 104, 106 and 108 spaced longitudinally of the beam 16 rearward of the mount 78. An arm 110 corresponding to the arm 80 is selectively positionable in one of the mounts 100, 102, 104, 106 or 108 and includes a sleeve 112 corresponding to the sleeve 84 provided with a setscrew 114 and a lever 116 corresponding to the setscrew 88 and lever 89. In addition, the sleeve 112 supports a standard 118 corresponding to the standard 86 and the upper end of the standard 118 includes a cradle 120 which is similar to the cradle 90 but which includes a horizontal blade 122 projecting toward the cradle 90 over the cradle 120. Of course, each of the mounts 100, 102, 104, 106 and 108 includes a pair of setscrews 124 corresponding to the setscrews 82. In operation, a tree log 126 is supported from the cradle 90 at its small diameter end and from the cradle 120 at its large diameter end with the threaded screw shaft 94 forcing the large diameter end of the log 126 into engagement with the blade 122. Thus, the log 126 is stationarily supported from the cradles 90 and 120. Once the log 126 has been placed in position, the arms 80 and 110 and the standards 86 and 118 may be adjusted as desired according to the diameters of the log 126 at the large and small diameter ends thereof, in order that the centerline of the log 126 will closely parallel the path along which the centers of curvatures of the edges 68 of the blades 66 move as the blades 66 reach their lowest points and during movement of the carriage assembly 32 forwardly along the rails 28 and 30 during operation of the router 62. After the correct positioning of the log 126 has been obtained, the router 62 is placed in operation and the carriage assembly 32 is moved forwardly along the rails 28 and 30 in order that the router 62 may form the first semi-cylindrical surface 128 on the log 126 during the initial pass of the router 62 forwardly along the log 126, see FIG. 6. After the surface 128 has been formed including a central longitudinal keyway 130 which is formed by the blade elements 70, the carriage assembly 32 is returned to the rear end of the frame 12 and the half completed log 126 is rotated 180° about its longitudinal axis with the opposite ends of the previously formed semi-cylindrical surface 128 cradled in the cradles 90 and 120 and the lug 92 received in the corresponding end of the keyway 130.

After the half completed log 126 has thus been supported from the cradles 90 and 120, the latter are adjusted to predetermined positions in order that the next semi-cylindrical surface to be formed on the log 126 will be coextensive with the first formed semi-cylindrical surface 128. After the cradles 90 and 120 have been thus adjusted, the carriage assembly 32 may again be moved forwardly along the frame 12 in order that the router 62 may make its second pass along the log 126 in order to form the second semi-cylindrical surface thereon coextensive with the first formed semi-cylindrical surface 128 and with a central outwardly opening keyway also formed in the second semi-cylindrical surface. Thus, the log 126 is readily transformed into a cylindrical log including diametrically opposite radially outwardly opening and longitudinally extending keyways.

Figure 12:
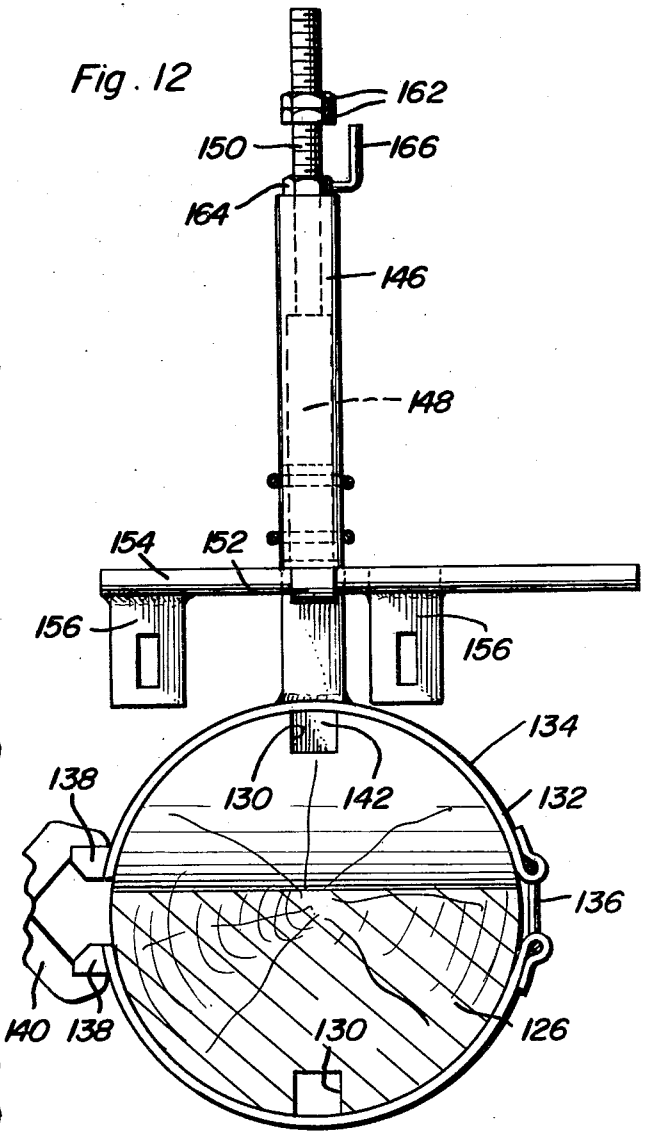
FIG. 12 is a cross sectional view of the structure of FIG. 11.
Figure 11:
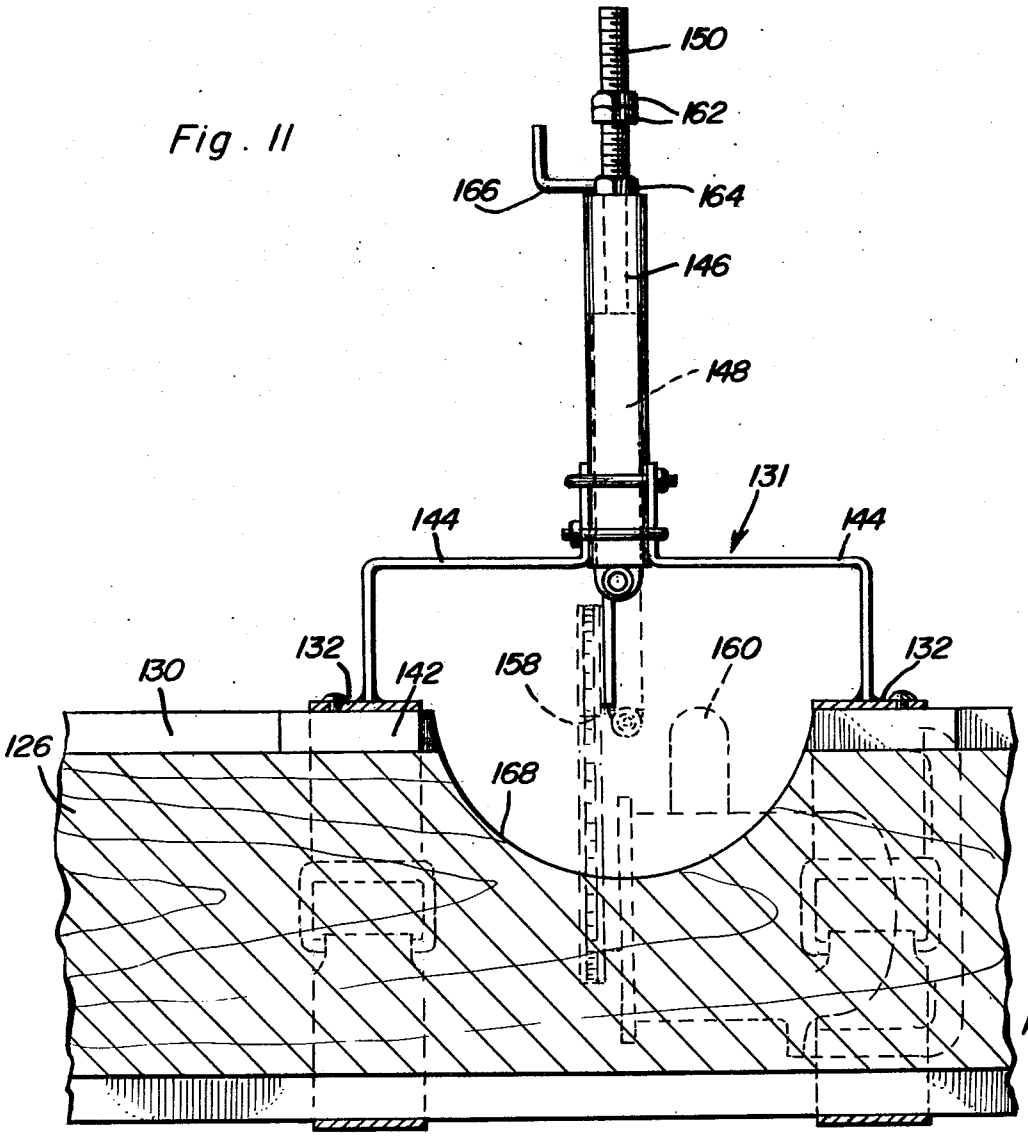
FIG. 11 is a vertical sectional view of a log end notching structure.

With attention now invited more specifically to FIGS. 11 and 12 of the drawings, a support structure referred to in general by the reference numeral 131 may be seen as including a pair of cylindrical clamp assemblies 132 with each assembly 132 including a pair of semi-cylindrical strap members 134 swingably joined together at one pair of corresponding ends as at 136 and including outwardly projecting lugs 138 at their other pair of corresponding ends. A vise grip wrench 140 is used to clamp each pair of lugs 138 toward each other and to thus clamp the strap members 134 of each clamp assembly 132 about the cylindrical log 126. In addition, each of the strap members 134 includes a lug 142 receivable in the corresponding keyway 130 and the clamp assemblies 132 are joined by means of support arms 144 to the lower end of a sleeve 146 with the clamp assemblies 132 positioned in coaxial relation. The sleeve 146 slidingly receives an elongated follower 148 therein including an upwardly projecting threaded shaft 150 which projects from the upper end of the sleeve 146 and the lower end of th follower 148 includes a horizontal transverse journal portion 152 which slidably receives and rotatably journals a horizontal support shaft 154 including a pair of coplanar radially outwardly projecting slotted mounting arms 156 which may be readily secured to the chain guiding blade 158 of a chain saw 160. The upper end portion of the threaded shaft 150 has a pair of jamnuts 162 mounted thereon for limiting downward displacement of the shaft 150 and thus the follower 148 and an adjusting nut 164 including a horizontally outwardly projecting crank handle 166 is threaded on the shaft 150 below the jamnuts 162. The nut 164 functions as a thrust washer against the upper end wall of the sleeve 146 through which the shaft 150 is snugly received and the nut 164 may thus be elevated along the shaft 150 in order to allow the latter and the journal portion 152 to be lowered.

In operation, the chain saw 160 has its blade 158 secured by suitable fasteners to the slotted plates 156 and the chain saw 160 is placed into operation and oscillated about the center axis of the shaft 154 as the nut 164 is slowly threaded upwardly along the shaft 150 in order to lower the journal portion 152 and the shaft 154. Thus, the lower reach of the chain saw chain will slowly cut a transverse semi-cylindrical mortise notch 168 in the long 126 with the jamnuts 162 limiting the depth of the notch 168.

Figures 3, 4, 5, 10:
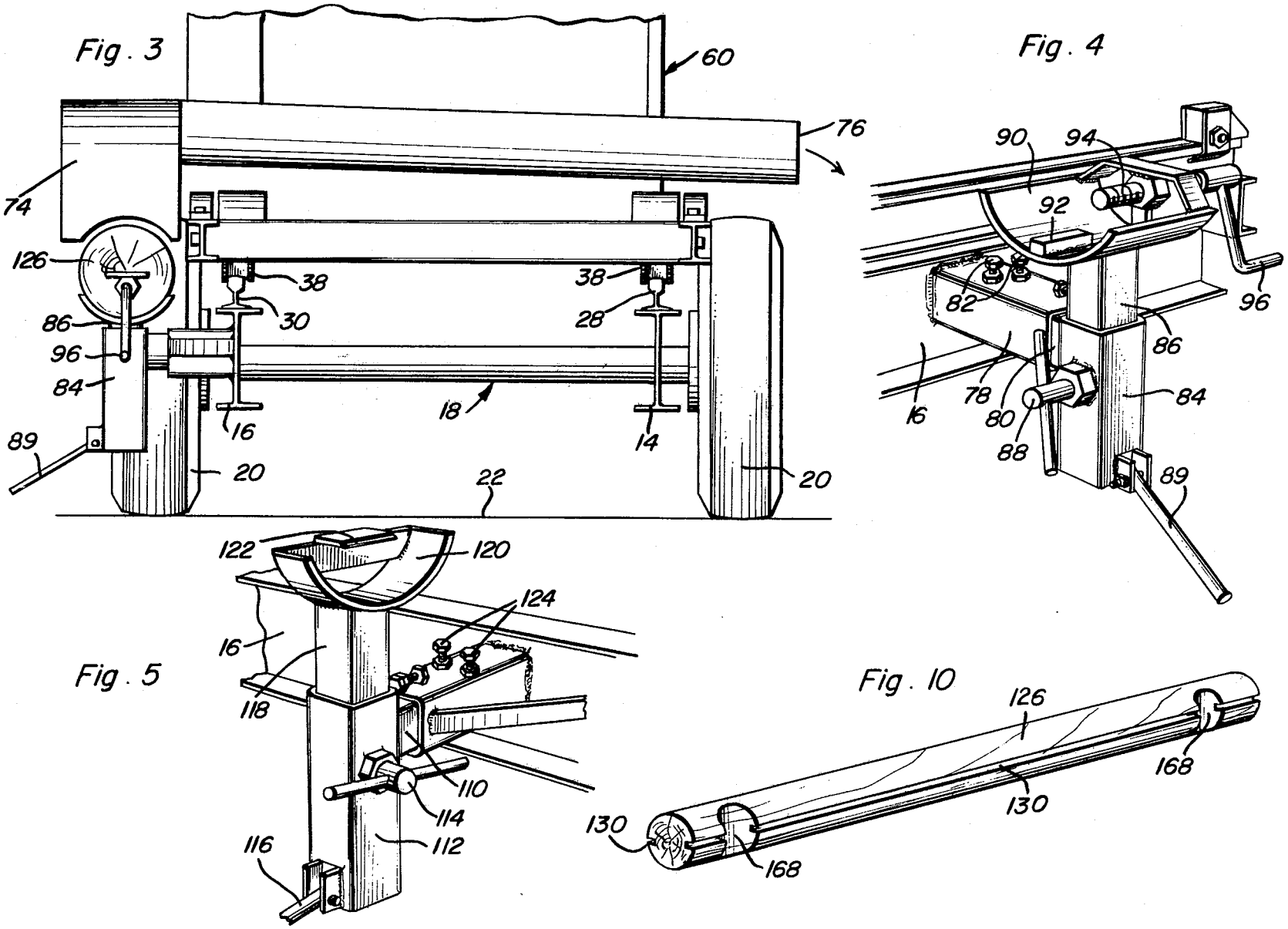
FIG. 3 is an end elevational view of the log shaper on somewhat of an enlarged scale and as seen from the right sides of FIGS. 1 and 2.
FIG. 4 is a fragmentary perspective view illustrating one of the head block structures for supporting one end of an associated tree log.
FIG. 5 is a fragmentary perspective view illustrating the other end block for supporting the opposite end of an associated log.
FIG. 10 comprises a perspective view of a finished cabin log.

Thus, the log 126 may be completed to the state thereof illustrated in FIG. 10 of the drawings so as to be substantially cylindrical and of constant diameter throughout its entire length, provide with diametrically opposite radially outwardly opening keyways and including the desired mortising notches 168 on its opposite ends.

If it is desired, the jackshaft 44 may be driven from the prime mover 60 through a suitable speed reduction drive connection including a clutch. Also, the front end of the frame or base 12 may include opposite side vertically adjustable landing gear assemblies for leveling the shaper 10 and facilitating its attachment to the draft vehicle. Still further, it will be apparent that merely by changing the router or cutter head 62 and the cradles 90 and 120, the entire shaper may be adjsuted to form cabin logs of different diameters.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. In combination, elongated base means including elongated guide structure, router means supported from said guide structure for guided movement therealong in a predetermined path, support means supported from said base means and defining a reference axis paralleling said path, said support means including means for stationarily supporting a log in position generally concentric with said axis, said router means including blade means operative to form a first convex semi-cylindrical surface generally concentric with said axis on a first adjacent side of a log supported along said axis and to form a central outwardly opening keyway groove in said surface extending therealong, said support means including key means receivable in said keyway groove, when said log is angularly displaced 180 degrees about its longitudinal axis subsequent to forming said first semi-cylindrical surface and keyway groove on and in said log, to support said log in keyed position from said support means with the side of said log remote from the first grooved semi-cylindrical surface opposing said path and said log positioned for forming a second grooved semicylindrical surface thereon by said router means with said first and second semi-cylindrical surfaces substantially coextensive and said keyway grooves substantially diametrically opposite each other.

2. The combination of claim 1 wherein said router means includes a rotary cutting head journaled for rotation about an axis transverse to said path and substantially normal to a plane containing said path and said refernece axis.

3. The combination of claim 1 including drive means for driving said router means back and forth along said guide structure.

4. The combination of claim 3 wherein said drive means includes a manually operable rotatable input shaft.

5. The combination of claim 1 wherein said router means includes a shroud having inlet and dischaarge ends and defines a blower located within the inlet end of said shroud for effecting rapid air flow through said shroudh to be exhausted from the discharge end thereof.

6. In combination, elongated base means including elongated guide structure, router means supported from said guide structure for guided movement therealong in a predetermined path, support means supported from said base means and definng a reference axis paralling said path, said support means including means for stationarily supporting a log in position generally concentric with said axis, said router means including blade means operative to form a first convex semi-cylindrical surface generally concentric with said axis on a first adjacent side of a log supported along said axis, said support means including means for keying said log in supported position on said support means, when said log angularly is displaced 180° about its longitudinal axis subsequent to forming said semi-cylindrical surface on said log, with the side of said log remote from semi-cylindrical surface opposing said path and said log repositioned on said support means for forming a second semi-cylindrical surface thereon by said router means with said first and second semi-cylindrical surfaces substantially co-extensive, said support means including a plurality of support portions space longitudinally of said base means laterally of said path and adjustably supported from said base means for independent shifting toward and away from said path and also laterally of a plane containing said path and reference axis.

7. The combination of claim 6 wherein said support means and said base means include means for selective support of one of said support portions in selected positions spaced along said base means.

8. The combination of claim 6 wherein said support portions are laterally spaced from said path below the latter and define upwardly opening partial cylindrical cradles for cradling the oppsite ends of said log.

9. A router head for transforming a large diameter tree log into a smaller diameter cylindrical cabin log, said router head including means for rotatably journaling said head about a center axis defined thereby, circumferentially spaced blades carried by said head and disposed in radial planes of said center axis, the outer ends of said blades including semi-cylindrical outwardly opening edges disposed in said radial planes terminating outwardly in oppositely outwardly directed edges, said blades including central outwardly projecting lug-type blade elements carried by the central portions of said semi-cylindrical cutting edges.

10. In combination, alongated base means including elongated guide structure, router means supported from said guide structure for guided movement therealong in a predetermined path, support means supported from said base means and defining a reference axis paralleling said path, said support means including means for stationarily supporting a log in position generally concentic with said axis, said router means including blade means operative to form a first convex semi-cylindrical surface generally concentric with said axis on a first adjacent side of a long supported along said axis, said support means including means for keying said log in supported position on said support means, when said log is angularly displaced 180° about its longitudinal axis subsequent to forming said semi-cylindrical surface on said log, with said log repositioned on said support means for forming a second semi-cylindrical surface thereon by said router means and with said first and second semi-cylindrical surface substantially co-extensive, said router means including a rotary cutting head journaled for rotation about an axis transverse to said path and substantially normal to a plane containing said path and said reference axis, said head including circumferentially spaced blades disposed in radial planes of the axis of rotation of said head, the outer ends of said blades including semi-cylindrical outwardly opening edges disposed in said radial planes and terminating outwardly at their opposite ends in oppositely outwardly directed edges, said blade including central outwardly projecting lug-types blade elements carried by the central portion of said semi-cylindrical cutting edges for forming a central outwardly opening keyway groove in each of said semi-cylindrical surfaces.

* * * * *